US007074102B2

(12) United States Patent
Teramoto

(10) Patent No.: US 7,074,102 B2
(45) Date of Patent: Jul. 11, 2006

(54) METHOD OF MANUFACTURING ELECTRON-EMITTING DEVICE, METHOD OF MANUFACTURING ELECTRON SOURCE, AND METHOD OF MANUFACTURING IMAGE DISPLAY DEVICE

(75) Inventor: Yoji Teramoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 10/758,193

(22) Filed: Jan. 16, 2004

(65) Prior Publication Data

US 2004/0253898 A1 Dec. 16, 2004

(30) Foreign Application Priority Data

Jun. 16, 2003 (JP) ..... 2003-170283

(51) Int. Cl.
*H01J 9/00* (2006.01)

(52) U.S. Cl. ..... 445/24

(58) Field of Classification Search ..... 445/23–25, 445/49–51

See application file for complete search history.

(56) References Cited

U.S. PATENT DOCUMENTS

| | | | | |
|---|---|---|---|---|
| 5,473,218 | A | 12/1995 | Moyer | 313/309 |
| 5,821,679 | A | 10/1998 | Makishima | 313/310 |
| 5,939,823 | A | 8/1999 | Kiyomiya et al. | 313/495 |
| 5,989,404 | A | 11/1999 | Kiyomiya et al. | 205/96 |
| 6,028,391 | A | 2/2000 | Makishima | 313/310 |

FOREIGN PATENT DOCUMENTS

| | | |
|---|---|---|
| JP | 03-261024 | 11/1991 |
| JP | 7-122179 | 5/1995 |
| JP | 08-55564 | 2/1996 |
| JP | 08-96703 | 4/1996 |
| JP | 08-96704 | 4/1996 |
| JP | 08-115654 | 5/1996 |
| JP | 08-264109 | 10/1996 |
| JP | 08-293244 | 11/1996 |
| JP | 2636630 | 4/1997 |
| JP | 10-125215 | 5/1998 |
| JP | 3010305 | 12/1999 |
| JP | 2000-67736 | 3/2000 |
| JP | 2000-323013 | 11/2000 |
| JP | 2001-126608 | 5/2001 |
| JP | 2001-256884 | 9/2001 |
| JP | 2002-140979 | 5/2002 |

*Primary Examiner*—Joseph Williams
(74) *Attorney, Agent, or Firm*—Fitzpatrick, Cella, Harper & Scinto

(57) ABSTRACT

A method of manufacturing an electron-emitting device, which has an easy manufacturing process and preferably controls an electron beam diameter. The method includes: arranging on a substrate a member comprising a first electroconductive layer blanketing the substrate, a layer containing at least one of materials forming an electron-emitting element blanketing the first electroconductive layer, a protective layer blanketing the layer containing at least one of materials, a second electroconductive layer blanketing the protective layer, an insulating layer blanketing the second electroconductive layer, and a third electroconductive layer blanketing the insulating layer; forming an opening, which extends from a surface of the third electroconductive layer to the protective layer, by dry etching; and wet-etching the protective layer through the opening to expose a portion of the layer containing at least one of the materials forming the electron-emitting element.

9 Claims, 6 Drawing Sheets

METHOD OF MANUFACTURING ELECTRON-EMITTING DEVICE, METHOD OF MANUFACTURING ELECTRON SOURCE, AND METHOD OF MANUFACTURING IMAGE DISPLAY DEVICE

BACKGROUND OF THE INVENTION

1. Field of the Invention

The present invention relates to a method of manufacturing an electron-emitting device, a method of manufacturing an electron source, and a method of manufacturing an image display device.

2. Related Background Art

An electron-emitting device includes a field emission type (hereinafter referred to as FE-type) electron-emitting device and a surface conduction type electron-emitting device.

With respect to the FE-type electron-emitting device, a spindt type is expected because of high efficiency. However, a process for manufacturing a spindt type electron-emitting device is complicated and an electron beam is easily dispersed. Therefore, in order to prevent the spread of the electron beam, it is necessary to arrange a focusing electrode above an electron-emitting region.

On the other hand, with respect to an example of an electron-emitting device having an electron beam diameter smaller than the spindt type, there is an electron-emitting device in which an insulating layer and a gate electrode which have a communicating opening (gate hole) are arranged on a cathode electrode and a flat thin film (electron-emitting film) is arranged on the bottom of the opening to emit electrons from the electron-emitting film. In the electron-emitting device having the flat electron-emitting film, relatively flat equipotential surfaces are produced above the electron-emitting film, so that the divergence of an electron beam becomes smaller than that of the Spindt type. The electron-emitting device using the flat electron-emitting film can be relatively easily manufactured. In addition, a drive voltage required for electron emission can be reduced. Further, because electrons are emitted substantially from the entire surface, the concentration of an electric current can be reduced. Therefore, the life of the electron-emitting device can be lengthened. A carbon electron-emitting film is proposed as the flat electron-emitting film. With respect to a method of reducing the electron beam diameter, there is an example in which a method of modifying a shape of the cathode electrode is used.

With respect to the above-mentioned FE-type electron-emitting device, there are electron-emitting devices disclosed in, for example, JP 08-096703 A, JP 08-096704 A, JP 08-293244 A, JP 08-264109 A, JP 08-055564 A, JP 08-115654 A, JP 10-125215 A, JP 2000-067736 A, JP 2001-256884 A, JP 2636630 B, and U.S. Pat. No. 5,473,218. With respect to the surface conduction electron-emitting device, there are electron-emitting devices disclosed in, for example, JP 3010305 B and JP 03-261024 A.

SUMMARY OF THE INVENTION

As for the method of arranging the electron-emitting film in a gate hole, there are two kinds of methods. That is, a method of forming a gate hole first and then depositing an electron-emitting film in the gate hole, and a method of first laminating an electron-emitting film, an insulating layer, and a gate electrode on a cathode electrode and then forming the opening (gate hole) penetrating the gate electrode and the insulating layer.

In the former method, there is a case where the electron-emitting film is adhered on the side wall portion of the gate hole at the time of formation of the electron-emitting film, thereby producing a leakage current between the gate electrode and the cathode electrode. On the other hand, in the latter method, the problem related to the leakage current is not caused. However, because the electron-emitting film becomes a layer serving as an etching stopper in a process for forming the opening, it is required that the electron-emitting film has a sufficiently low etching rate with respect to etching. This causes a reduction in process margin such as the selection of insulating materials, the selection of electron-emitting film materials, or the selection of etching processes. Further, because the electron-emitting film is subjected to an etching process for a long time, there is a case where the electron-emitting film is deteriorated by plasma or the like.

Also, in order to converge an electron beam emitted from the electron-emitting film, a structure is disclosed in which the surface of the cathode electrode arranged in the gate hole is formed in a concave shape and the electron-emitting film is arranged so as to fit in the concave portion of the cathode electrode. In such a structure, the trajectory of the electron beam is controlled according to a width and a depth of the concave portion of the cathode electrode. Thus, it is necessary to control the shape of the concave portion with high precision.

Therefore, an object of the present invention is to provide a method of manufacturing a field emission type electron-emitting device, a method of manufacturing an electron source, and a method of manufacturing an image display device, each of which has an easy manufacturing process and preferably controls an electron beam diameter.

A method of the present invention which is made to achieve the above-mentioned object is as follows.

That is, the present invention provides a method of manufacturing an electron-emitting device, including:

(A) arranging on a substrate a member comprising a first electroconductive layer blanketing the substrate, a layer containing at least one of materials composing an electron-emitting element blanketing the first electroconductive layer, a protective layer blanketing the layer containing at least one of materials composing an electron-emitting element, a second electroconductive layer blanketing the protective layer, an insulating layer blanketing the second electroconductive layer, and a third electroconductive layer blanketing the insulating layer;

(B) forming an opening, which extends from a surface of the third electroconductive layer to the protective layer, by dry etching; and (C) wet-etching the protective layer through the opening to expose a portion of the layer containing at least one of the materials composing the electron-emitting element.

The method of manufacturing an electron-emitting device according to the present invention preferably includes the following structure, in which: the protective layer is made of a material having a lower etching rate than the second electroconductive layer; the protective layer is made of a metal; the protective layer is made of one of a silicon nitride and a silicon oxide; the first electroconductive layer composes a cathode electrode, the second electroconductive layer composes a focusing electrode, and the third electroconductive layer composes a gate electrode; the electron-emitting element contains mainly carbon; the electron-emitting element is one of diamond, diamond-like carbon, and a carbon fiber.

Further, according to the present invention, there is provided a method of manufacturing an electron source including a plurality of electron-emitting devices, the method including:

manufacturing the electron-emitting devices by the manufacturing method of the present invention.

Furthermore, according to the present invention, there is provided a method of manufacturing an image display device including an electron source and a light emitting member that emits light by electron irradiation, the method including:

manufacturing the electron source by the manufacturing method of the present invention.

DESCRIPTION OF THE PREFERRED EMBODIMENTS

Hereinafter, a preferred embodiment of the present invention will be illustratively described in detail with reference to the drawings. Note that, with respect to sizes, materials, shapes, relative arrangements, and the like of structural parts which are described in the following embodiment, which is not intended to limit the scope of the present invention, unless otherwise specifically described.

Figure 1:
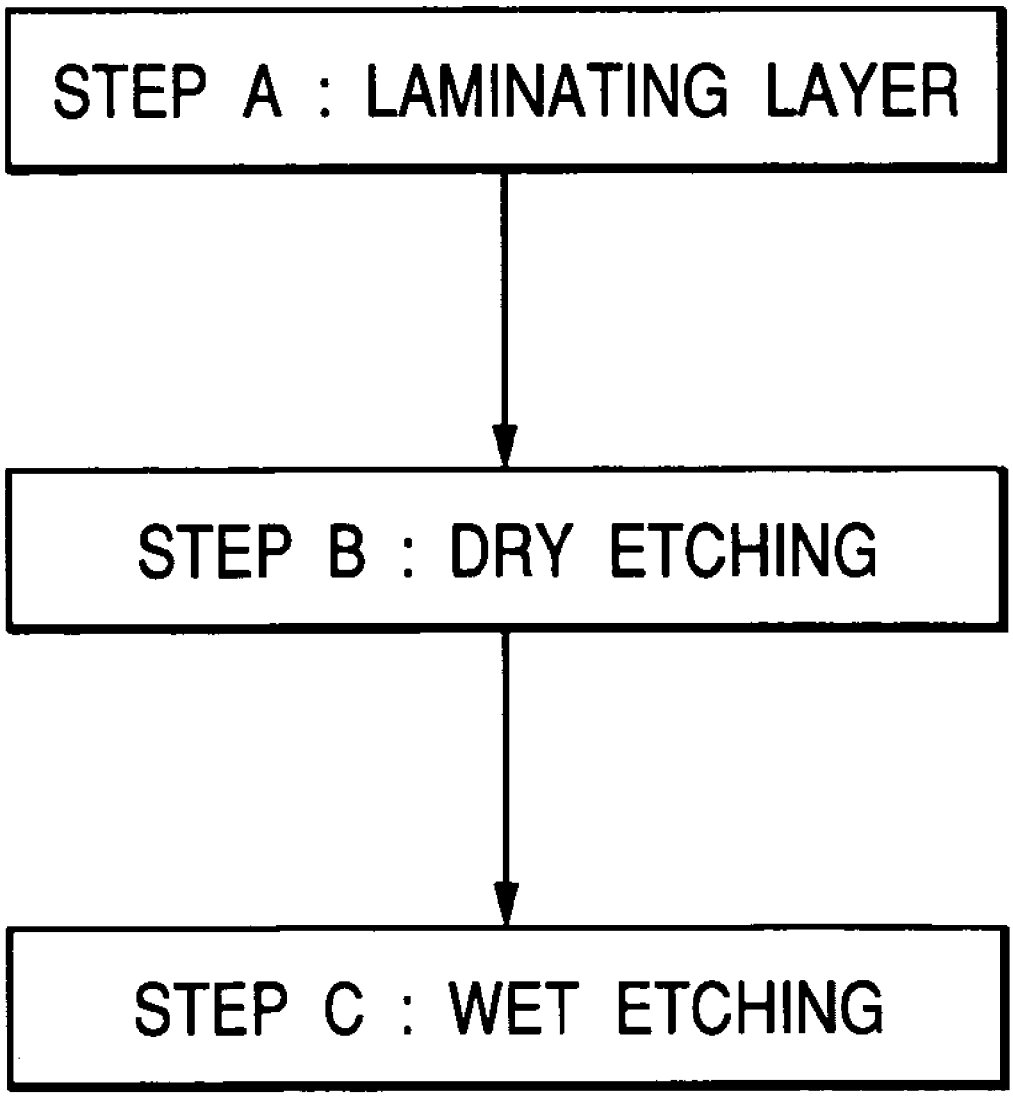
FIG. 1 is a flow chart showing a method of manufacturing an electron-emitting device according to the present invention.
Figure 2A:
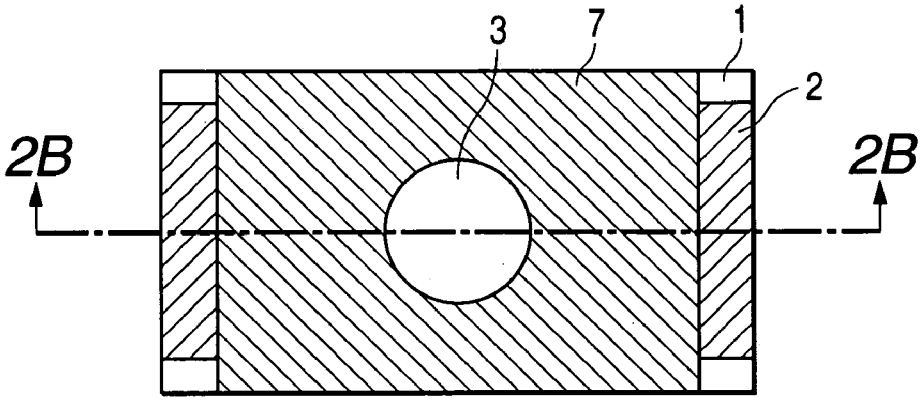
FIGS. 2A and 2B are a plan view and a cross sectional view each showing a structure of the electron-emitting device according to the present invention.
Figure 2B:
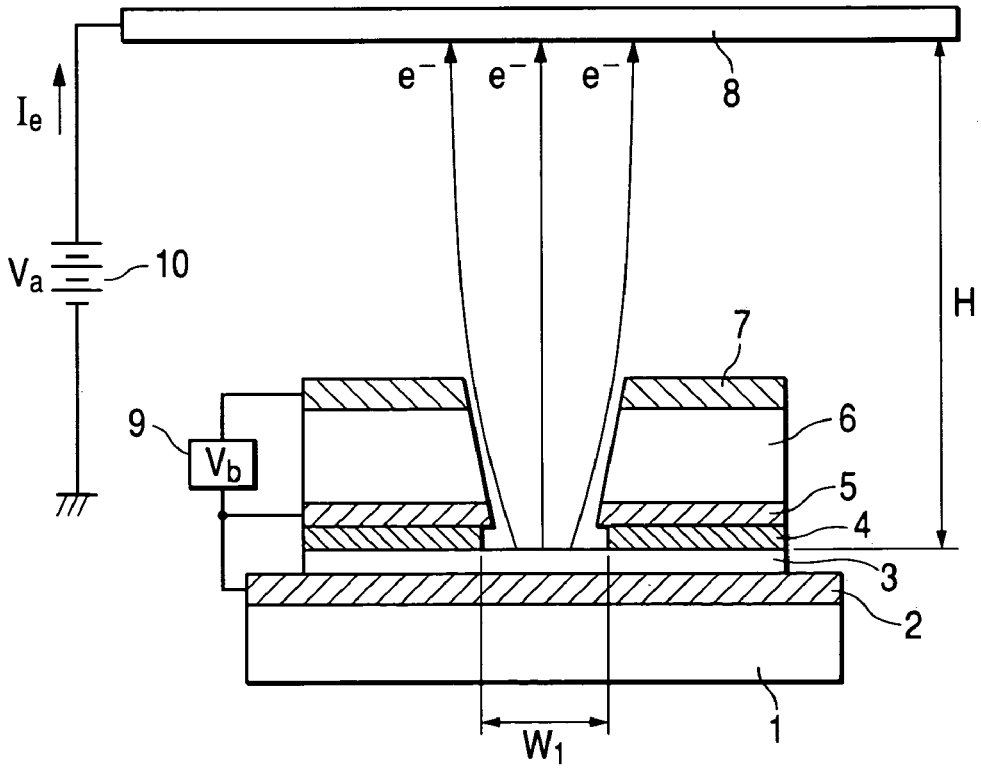

FIG. 1 is a flow chart showing a method of manufacturing an electron-emitting device according to the present invention. FIGS. 2A and 2B are schematic views showing a most fundamental structure of the electron-emitting device manufactured by the manufacturing method according to the present invention. FIG. 2A is a plan view and FIG. 2B is a cross sectional view which corresponds to a cross sectional view taken along a line 2B—2B in FIG. 2A. In FIG. 2A and FIG. 2B, reference numeral 1 denotes a substrate; 2, a cathode electrode(first electroconductive layer); 3, an electron-emitting film; 4, a protective film; 5, a focusing electrode(second electroconductive layer); 6, an insulating layer; 7, a gate electrode(third electroconductive layer); 8, an anode electrode; 9, a drive power source; 10, a high voltage power source; and reference symbol W1, an opening diameter.

According to the structure shown in FIG. 2A and FIG. 2B, the cathode electrode 2 and the focusing electrode 5 are short-circuited such that their potentials are equal to each other, in this example. Reference symbol Vb denotes a voltage applied between the gate electrode 7 and the cathode electrode 2; Va, a voltage applied to the anode electrode 8; and Ie, an electron emission current.

When Vb and Va are applied to drive the electron-emitting device, a strong electric field is produced in a hole. A shape of an equipotential surface in the hole is determined according to Vb, a thickness of the insulating layer 6, a shape thereof, a dielectric constant of the insulating layer, and the like. Substantially parallel equipotential surfaces are produced outside the hole by Va depending on mainly a distance H between the electron-emitting film 3 and the anode electrode 8. If the electric field applied to the electron-emitting film 3 exceeds a threshold value, electrons are emitted from the electron-emitting film 3. The electrons passing through the hole collide with the anode electrode 8.

Figure 3:
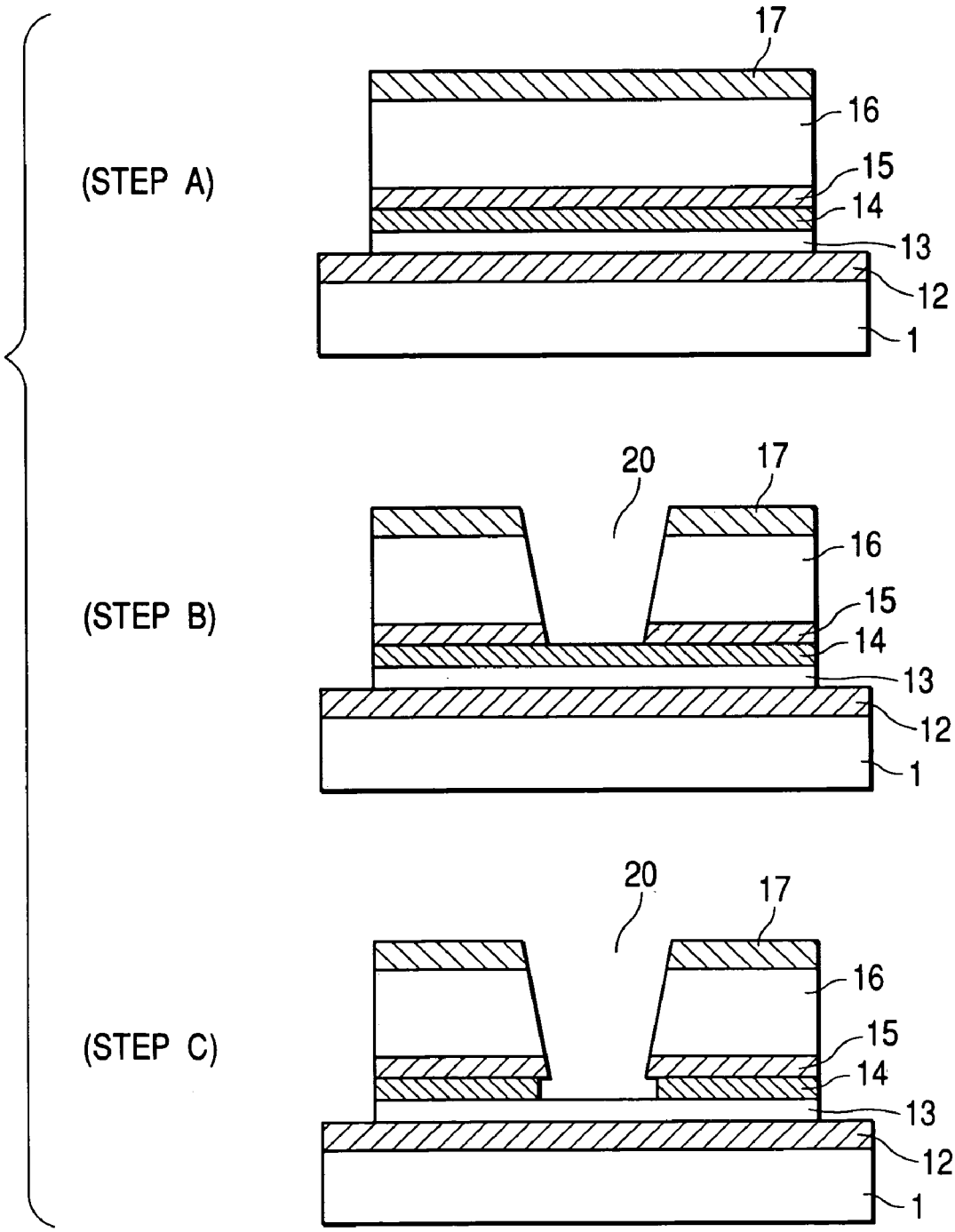
FIG. 3 schematically shows an example of a method of manufacturing the electron-emitting device according to the present invention.

FIG. 3 schematically shows an example of a method of manufacturing the electron-emitting device according to the present invention, with three cross sectional views corresponding to respective steps in the flow chart shown in FIG. 1. In FIG. 3, reference numeral 12 denotes a first electroconductive layer; 13, a layer containing at least one of materials composing an electron-emitting element; 14, a protective layer; 15, a second electroconductive layer; 16, an insulating layer; and 17, a third electroconductive layer.

(Step A)

<Step a-1>

The first electroconductive layer 12 serving as the cathode electrode 2 shown in FIG. 2B is laminated on a substrate 1 whose surface is sufficiently washed in advance.

With respect to the substrate 1, there can be used a quartz glass substrate, a glass substrate in which the amount of contained impurity such as Na is reduced, a soda lime glass substrate, a laminate in which $SiO_2$ is deposited on a silicon substrate by a sputtering method or the like, a ceramic insulating substrate made of a material such as alumina, and the like.

The first electroconductive layer 12 is made of an electroconductive material, and can be formed by a general film formation technique such as an evaporation method or a sputtering method and a photolithography technique. For example, a metal such as Be, Mg, Ti, Zr, Hf, V, Nb, Ta, Mo, W, Al, Cu, Ni, Cr, Au, Pt, or Pd, or an alloy containing these metals can be used as a material of the first electroconductive layer 12. A thickness of the first electroconductive layer 12 is set in a range of several tens nm to several mm, preferably, selected from a range of several hundreds nm to several μm.

<Step a-2>

The layer 13 containing at least one of materials composing the electron-emitting element is arranged on the surface of the first electroconductive layer 12 to form the electron-emitting film 3. The layer 13 containing at least one of materials composing the electron-emitting element can be formed by an evaporation method, a sputtering method, a printing method, or the like.

It is preferable that the electron-emitting element according to the present invention contains mainly carbon. For example, graphite, fullerene such as C60, a carbon fiber such as a carbon nanotube or a graphite nanofibet, diamond-like carbon, carbon in which diamonds are dispersed, a carbon compound, or the like is selected as appropriate. A diamond thin film having a low work function, diamond-like carbon, or a carbon fiber is preferable.

A thickness of the layer 13 containing at least one of materials composing the electron-emitting element is set in a range of several nm to several μm, preferably, selected from a range of several nm to several hundreds nm.

<Step a-3>

The protective layer 14 serving as the protective layer 4 shown in FIG. 2B is formed on the layer 13 containing at least one of materials composing the electron-emitting element. The protective layer 14 can be formed by an evaporation method, a sputtering method, a printing method, or the like. A material of the protective layer 14 is selected as appropriate from, for example, a dielectric such as $SiO_2$ or $SiN_x$, a metal such as Be, Mg, Ti, Zr, Hf, V, Nb, Ta, Mo, W, Al, Cu, Ni, Cr, Au, Pt, or Pd, an alloy containing these metals, a carbide such as TiC, ZrC, HfC, TaC, SiC, or WC, a boride such as $HfB_2$, $ZrB_2$, $LaB_6$, $CeB_6$, $YB_4$, or $GdB_4$, a nitride such as TiN, ZrN, or HfN, a semiconductor such as Si or Ge, and the like. Of those materials, a silicon nitride, a silicon oxide, or a metal is preferably used.

Also, it is preferable to select a material having a higher etching rate in a wet etching step described later than the layer 13 containing at least one of materials composing the electron-emitting element. In addition, it is desirable that the etching rate in the wet etching step is ten or more times higher than the etching rate of the layer 13 containing at least one of materials composing the electron-emitting element. A thickness of the protective layer 14 is set in a range of several nm to several μm, preferably, selected from a range of several nm to several hundreds nm.

<Step a-4>

The second electroconductive layer 15 serving as the focusing electrode 5 shown in FIG. 2B is arranged on the protective layer 14. The second electroconductive layer 15 has conductivity and can be formed by an evaporation method, a sputtering method, a printing method, or the like. For example, a metal such as Be, Mg, Ti, Zr, Hf, V, Nb, Ta, Mo, W, Al, Cu, Ni, Cr, Au, Pt, or Pd, or an alloy containing these metals, or the like can be used as a material of the second electroconductive layer 15. A thickness of the second electroconductive layer 15 is set in a range of several tens nm to several mm, preferably, selected from a range of several hundreds nm to several μm.

<Step a-5>

The insulating layer 16 serving as the insulating layer 6 shown in FIG. 2B is deposited on the second electroconductive layer 15. The insulating layer 16 can be formed by a sputtering method, a CVD method, a vacuum evaporation method, a printing method, or the like. A thickness of the insulating layer 16 is set in a range of several nm to several μm, preferably, selected from a range of several tens nm to several hundreds nm. It is desirable to use a high withstanding material which is resistant to a high electric field, such as $SiO_2$, SiN, $Al_2O_3$, CaF, or undoped diamond.

<Step a-6>

The third electroconductive layer 17 serving as the gate electrode 7 shown in FIG. 2B is arranged on the insulating layer 16. The third electroconductive layer 17 has conductivity and can be formed by the same method as the first electroconductive layer 12 described above. A material of the third electroconductive layer 17 can be appropriately chosen from the material group which can be applied to the first electroconductive layer 12. A thickness of the third electroconductive layer 17 is set in a range of several nm to several tens μm, preferably, selected from a range of several tens nm to several μm.

Note that the first electroconductive layer 12, the second electroconductive layer 15, and the third electroconductive layer 17 may be made of an identical material or different kinds of materials and formed by an identical formation method or different kinds of methods. Here, an example is described in which the respective layers are laminated in succession through <Step a-1> to <Step a-6>. The following example is also possible. That is, some or all of the layers formed through <Step a-1> to <Step a-6> are prepared in advance as a laminate(member). Then, the laminate (member) is laminated (stacked) on a substrate to correspond to <Step a-1> to <Step a-6>.

(Step B)

A mask (not shown) is formed on the third electroconductive layer 17 by a photolithography technique or the like. The mask has a pattern (opening) for forming an opening 20 that penetrates the second electroconductive layer 15, the insulating layer 16, and the third electroconductive layer 17, which are formed through the above-mentioned Step A. Then, a dry etching step is conducted using the mask to form the opening 20 that penetrates the second electroconductive layer 15, the insulating layer 16, and the third electroconductive layer 17 and reaches the upper surface of the protective layer 14 (the protective layer 14 is thus exposed). The protective layer 14 serves as an etching stop layer. Note that a plan shape of the opening 20 is not limited to a circle.

In the dry etching step above, it is desirable that an etching rate of the protective layer 14 is lower than an etching rate of the second electroconductive layer 15. More specifically, an etching rate of 1/10 or less is desirable. After the completion of the dry etching step, the mask having the pattern is removed.

(Step C)

A wet etching step is conducted on the protective layer 14. According to the step, a portion of the layer 13 containing at least one of materials composing the electron-emitting element is exposed to the opening 20. In the wet etching step, it is preferable that the protective layer 14 can be etched and an etching rate thereof is larger than that of the third electroconductive layer 17, the insulating layer 16, the second electroconductive layer 15. In addition, it is desirable that the layer 13 containing at least one of materials composing the electron-emitting element is neither etched nor substantially deteriorated.

Note that "the layer" in "the layer 13 containing at least one of materials composing the electron-emitting element" which is formed through <Step a-2> indicates not only a continuous film but includes a layer arranged on the first electroconductive layer 12 with a state in which members different from the first electroconductive layer 12 are separated from each other (or with a state in which the members are partially in contact with each other).

Therefore, "the layer 13 containing at least one of materials composing the electron-emitting element" may be a layer composed of only the electron-emitting element or a layer obtained by applying a disperse medium such as a printing paste in which materials of the electron-emitting element are dispersed. Further, the layer 13 may be a layer containing a member composing a portion of the finally obtained electron-emitting element, such as a member that becomes the electron-emitting element by a process conducted after <Step a-2>, or a layer formed from a plurality of catalytic particles for electron-emitting element(ex. catalytically grown carbon fibers) formation by a process conducted after <Step a-2>.

Thus, a method can be also used in which a portion of the electron-emitting element (or a catalyst for forming the electron-emitting element) is formed in <Step a-2> and then the remaining portion of the electron-emitting element is formed after the above-mentioned Step C. This method can be used, for example, in the case where a carbon fiber is grown by CVD method. In other words, the plurality of catalytic particles (or a layer containing the plurality of catalytic particles) are arranged on the first electroconductive layer 12 in <Step a-2> and then CVD method is conducted in a carbon compound gas atmosphere after Step C. As a result, a carbon fiber such as a carbon nanotube or a graphite nanofiber can be grown as the electron-emitting element on the first electroconductive layer 12 by using the catalytic action of the catalytic particles exposed to the opening 20.

Also, as described above, in the case where the remaining portion of the electron-emitting element is formed from <Step a-2> onward, it is controlled such that the thickness of the finally obtained electron-emitting film 3 (layer composed of the electron-emitting element or a layer containing the electron-emitting element) becomes smaller than an interval between the cathode electrode 12 and the second electroconductive layer 15.

Next, an application example of an electron-emitting device manufactured by the manufacturing method according to the present invention will be described below. A plurality of electron-emitting devices manufactured by the manufacturing method according to the present invention are arranged on the surface of the same base, so that, for example, an electron source or an image display device can be constructed.

Figure 4:
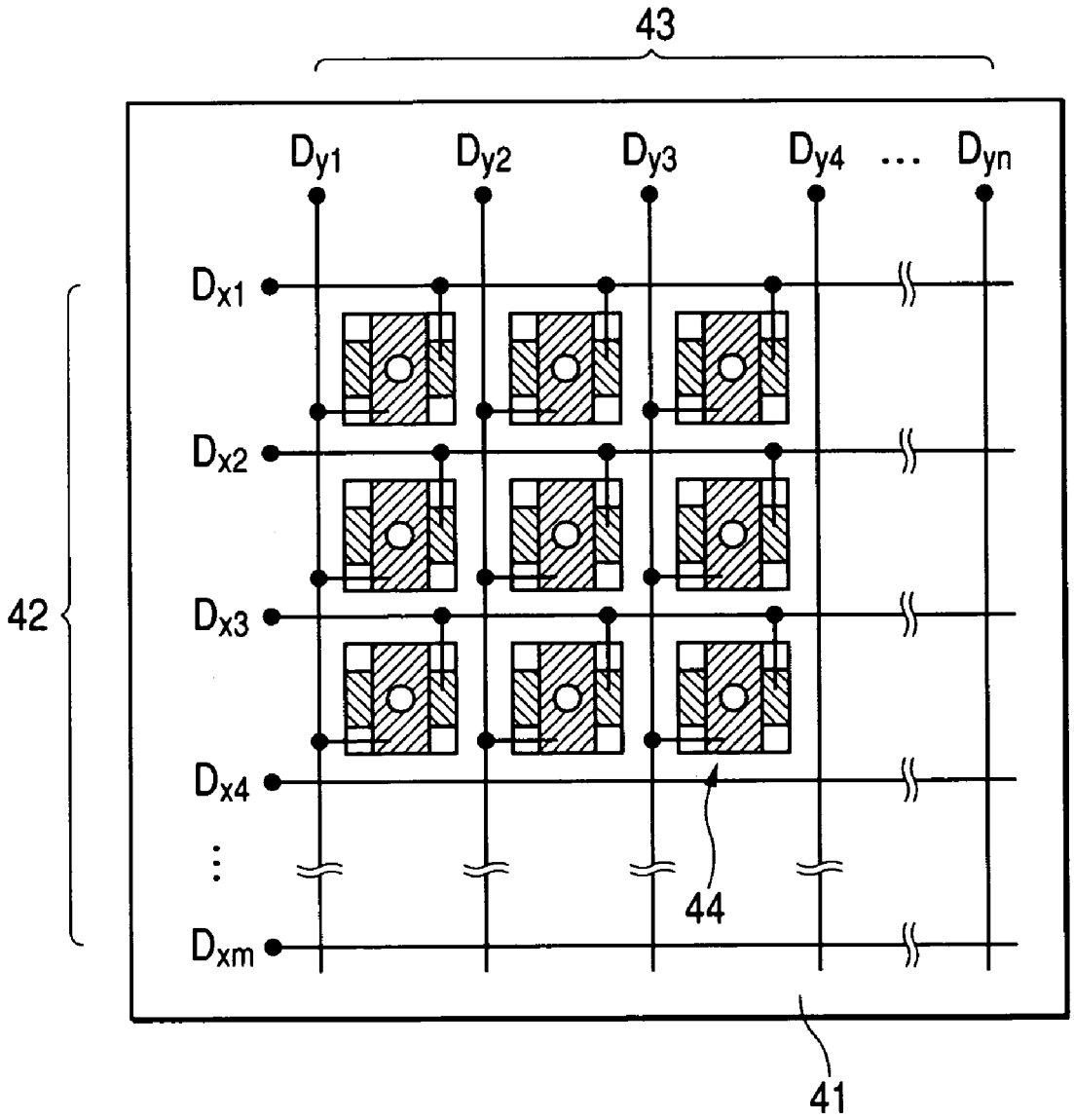
FIG. 4 is a structural view showing an electron source with a passive matrix arrangement according to the present invention.

An electron source obtained by arranging the plurality of electron-emitting devices manufactured by the manufacturing method according to the present invention will be described with reference to FIG. 4. In FIG. 4, the electron source includes an electron source base 41, an X-directional wirings 42, a Y-directional wirings 43, and electron-emitting devices 44 according to the present invention.

The X-directional wirings 42 is composed of m wirings Dx1, Dx2, . . . , Dxm and can be made from an electroconductive metal film which is formed by a vacuum evaporation method, a printing method, a sputtering method, or the like. A material, a film thickness, and a width of the wirings are designed as appropriate. The Y-directional wirings 43 is composed of n wirings Dy1, Dy2, . . . , Dyn and formed as in the case of the X-directional wirings 42. An interlayer insulating film which is not shown is provided between the X-directional wirings 42 composed of the m wirings and the Y-directional wirings 43 composed of the n wirings and electrically insulates therebetween. Here, m and n each are a positive integer. The interlayer insulating film which is not shown is made from an $SiO_2$ film or the like which is formed by a vacuum evaporation method, a printing method, a sputtering method, or the like. The X-directional wirings 42 and the Y-directional wirings 43 can be led as external terminals.

The cathode electrode and the gate electrode which compose each of the electron-emitting devices 44 are electrically connected with one of the m wirings of the X-directional wirings 42 and one of the n wirings of the Y-directional wirings 43, respectively.

With respect to materials that compose the X-directional wirings 42, the Y-directional wirings 43, the cathode electrodes, and the gate electrodes, a part or all of these constitutional elements may be identical or different from one another. In the case where the material that composes the cathode electrodes and the gate electrodes is identical to the wiring material, the X-directional wirings 42 and the Y-directional wirings 43 can be also called the cathode electrode group and the gate electrode group, respectively.

The X-directional wirings 42 is connected with a scanning signal applying unit (not shown) that applies a scanning signal to select a row of the electron-emitting devices 44 arranged in the X-direction. On the other hand, the Y-directional wirings 43 is connected with a modulation signal generating unit (not shown) that modulates a signal for each column of the electron-emitting devices 44 arranged in the Y-direction according to an input signal. A drive voltage applied to each of the electron-emitting devices is supplied as a differential voltage between the scanning signal and a modulation signal which are applied to the corresponding electron-emitting device.

Figure 5:
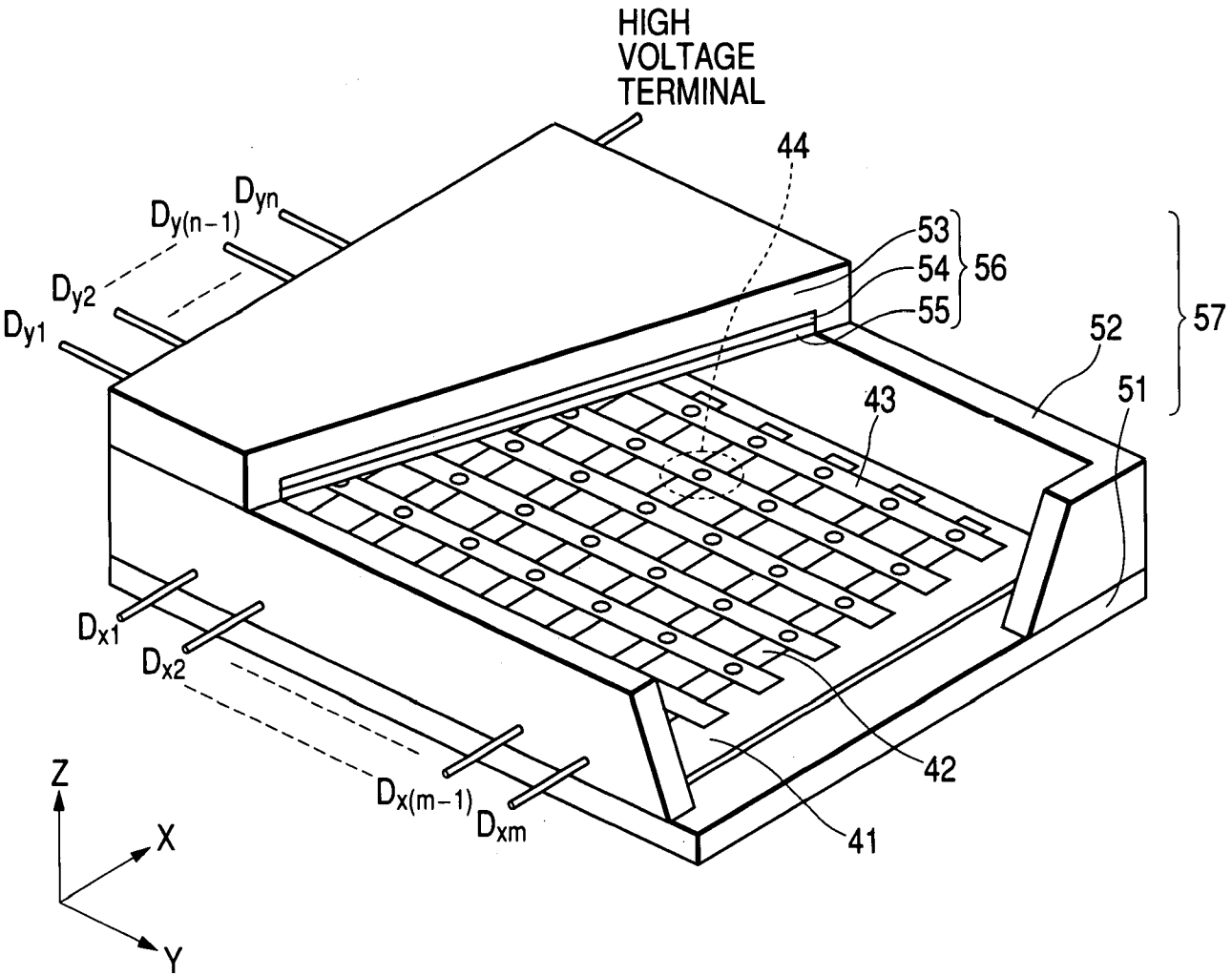
FIG. 5 is a schematic structural view showing an image display device using the electron source with the passive matrix arrangement according to the present invention.
Figure 6A:
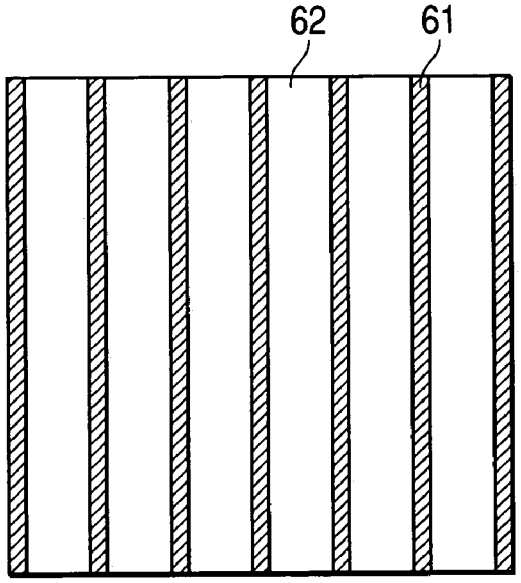
FIGS. 6A and 6B show a fluorescent film in an image forming apparatus according to the present invention.
Figure 6B:
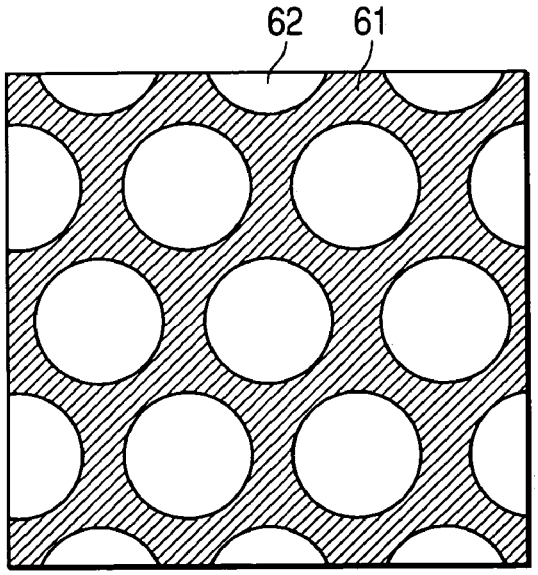

In the above-mentioned structure, the electron-emitting devices can be individually selected and separately driven. An image display device constructed using the electron source having such a matrix arraignment will be described with reference to FIG. 5. FIG. 5 is a schematic view showing an example of a display panel of the image display device.

In FIG. 5, reference numeral 41 denotes an electron source base on which a plurality of electron-emitting devices are arranged; 51, a rear plate onto which the electron source base 41 is fixed; and 56, a face plate in which a phosphor film 54 made from a light emission member such as a phosphor and a metal back 55 serving as the anode electrode are formed on the inner surface of a glass base 53. Reference numeral 52 denotes a support frame. The support frame 52 is bonded to the rear plate 51 and the face plate 56 using frit glass or the like. Reference numeral 57 denotes an envelope. The envelope 57 is baked for seal bonding, for example, in an atmosphere or a nitrogen atmosphere at a temperature of 400° C. to 500° C. for 10 minutes or longer.

As described above, the envelope 57 is composed of the face plate 56, the support frame 52, and the rear plate 51. The rear plate 51 is provided to reinforce mainly the strength of the electron source base 41. Therefore, in the case where the electron source base 41 itself has a sufficient strength, a separate rear plate 51 can be omitted. In other words, the support frame 52 may be directly bonded for sealing to the electron source base 41 to obtain the envelope 57 composed of the face plate 56, the support frame 52, and the electron source base 41. On the other hand, in the case where supporters (not shown) which are called spacers are provided between the face plate 56 and the rear plate 51, the envelope 57 which has a sufficient strength to an atmospheric pressure can be constructed.

The image display device according to the present invention can be used as a display device for television broadcast, a display device for a television conference system, a computer or the like, an image display device serving as an optical printer constructed using a photosensitive drum and the like.

Hereinafter, embodiments of the present invention will be described in detail.

EXAMPLE 1

An electron-emitting device having the structure shown in FIGS. 2A and 2B was manufactured according to the steps shown in FIG. 3.

(Step 1)

The substrate 1 made of quartz was used and sufficiently washed, and then an Al film having a thickness of 300 nm was formed as the first electroconductive layer 12 on the substrate 1 by a sputtering method.

(Step 2)

A diamond-like carbon film was deposited on the first electroconductive layer 12 at about 30 nm by using plasma CVD method to obtain the electron-emitting film 3.

(Step 3)

A Cr film was formed as the protective layer 14 on the layer 13 containing at least one of materials composing the electron-emitting element by a sputtering method such that a thickness of the Cr film becomes 50 nm.

(Step 4)

A Ta film was formed as the second electroconductive layer 15 on the protective layer 14 such that a thickness of the Ta film became 50 nm.

(Step 5)

In order to form the insulating layer 16, an $SiO_2$ film was formed at about 1000 nm by plasma CVD method using $SiH_4$ and $O_2$ as raw gases.

(Step 6)

Next, a Ta film was formed as the third electroconductive layer 17 on the insulating layer 16 such that a thickness of the Ta film became 100 nm.

(Step 7)

A positive type photo resist was formed on the third electroconductive layer 17 by spin coating. Then, a photo mask pattern (circle) was exposed and developed to form a mask pattern (circular opening). In this time, an opening diameter W1 was set to 1.5 μm.

(Step 8)

Dry etching was conducted under such conditions that an etching gas was a mixture gas of $CF_4$ and $H_2$, etching power was 150 W, and an etching pressure was 5 Pa, to stop etching on the upper surface of the protective layer 14, thereby forming the opening 20.

(Step 9)

The remaining mask pattern (nor shown) was removed by a peeling solution (peeling solution 104: produced by Tokyo Ohka Kogyo Co., Ltd.).

(Step 10)

Next, the exposed protective layer 14 was wet-etched for 30 seconds using a mixture solution of $(NH_4)_2Ce(NO)_6$, $HClO_4$, and $H_2O$ and washed with water for 30 seconds to complete the electron-emitting device of this example.

EXAMPLE 2

An electron-emitting device having the structure shown in FIGS. 2A and 2B was manufactured according to the steps shown in FIG. 3.

(Step 1)

The substrate 1 made of quartz was used and sufficiently washed, and then a Pt film having a thickness of 300 nm was formed as the first electroconductive layer 12 on the substrate 1 by a sputtering method.

(Step 2)

A diamond-like carbon film was deposited on the first electroconductive layer 12 at about 100 nm by using plasma CVD method to obtain the electron-emitting film 3.

(Step 3)

In order to form the protective layer 14, an $SiO_2$ film was formed at about 50 nm by plasma CVD method using $SiH_4$ and $O_2$ as raw gases.

(Step 4)

A Cr film having a thickness of 50 nm was formed as the second electroconductive layer 15 on the protective layer 14 by a sputtering method.

(Step 5)

In order to form the insulating layer 16, an $SiO_2$ film was formed at about 1000 nm by plasma CVD method using $SiH_4$ and $O_2$ as raw gases.

(Step 6)

A Ta film was formed by resistance heating vapor deposition as the third electroconductive layer 17 on the insulating layer 16 such that a thickness of the Ta film became 100 nm.

Next, a positive type photo resist was formed on the third electroconductive layer 17 by spin coating. Then, a photo mask pattern (circle) was exposed and developed to form a mask pattern (circular opening). In this time, an opening diameter W1 was set to 1.5 μm.

(Step 7)

Dry etching was conducted under such conditions that an etching gas was a mixture gas of $CF_4$ and $H_2$, etching power was 150 W, and an etching pressure was 5 Pa, to stop etching on the upper surface of the second electroconductive layer 15. After that, the second electroconductive layer 15 was dry-etched under such conditions that an etching gas was $O_2$, etching power was 150 W, and an etching pressure was 10 Pa, to stop etching on the upper surface of the protective layer 14, thereby forming the opening 20.

(Step 8)

The remaining mask pattern was removed by a peeling solution (peeling solution 104: produced by Tokyo Ohka Kogyo Co., Ltd.).

(Step 9)

The resultant substrate 1 was immersed into BHF (HF (50%): $NH_4F$ (40%)=1:5) for 10 seconds to wet-etch the protective layer 14 and washed with water for 30 seconds, to complete the electron-emitting device of this example.

EXAMPLE 3

(Step 1)

The substrate 1 made of quartz was used and sufficiently washed, and then a Pt film having a thickness of 300 nm was formed as the first electroconductive layer 12 on the substrate 1 by a sputtering method.

(Step 2)

A large number of Co particles (catalytic, particles) were deposited for the layer 13 containing at least one of materials composing the electron-emitting element on the first electroconductive layer 12 by a sputtering method.

(Step 3)

In order to form the protective layer 14, an $SiO_2$ film was formed at about 50 nm by plasma CVD method using $SiH_4$ and $O_2$ as raw gases.

(Step 4)

A Cr film having a thickness of 50 nm was formed as the second electroconductive layer 15 on the protective layer 14 by a sputtering method.

(Step 5)

In order to form the insulating layer 16, an $SiO_2$ film was formed at about 1000 nm by plasma CVD method using $SiH_4$ and $O_2$ as raw gases.

(Step 6)

A Ta film was formed by resistance heating vapor deposition as the third electroconductive layer 17 on the insulating layer 16 such that a thickness of the Ta film became 100 nm.

Next, a positive type photo resist was formed on the third electroconductive layer 17 by spin coating. Then, a photo mask pattern (circle) was exposed and developed to form a mask pattern (circular opening). In this time, an opening diameter W1 was set to 1.5 μm.

(Step 7)

Next, dry etching was conducted under such conditions that an etching gas was a mixture gas of $CF_4$ and $H_2$, etching power was 150 W, and an etching pressure was 5 Pa, to stop etching on the upper surface of the second electroconductive layer 15. After that, the second electroconductive layer 15 was dry-etched under such conditions that an etching gas was $O_2$, etching power was 150 W, and an etching pressure was 10 Pa, to stop etching on the upper surface of the protective layer 14, thereby forming the opening 20.

(Step 8)

The remaining mask pattern was removed by a peeling solution (peeling solution 104: produced by Tokyo Ohka Kogyo Co., Ltd.).

(Step 9)

Next, the resultant substrate 1 was immersed into BHF (HF (50%): $NH_4F$ (40%)=1:5) for 10 seconds to wet-etch the protective layer 14 and washed with water for 30 seconds.

(Step 10)

Heating was conducted in $C_2H_4$ at 600° C. As a result, a carbon fiber was grown on the first electroconductive layer 12 through the Co particles exposed to the circular opening 20 such that the carbon fiber became a height equal to or lower than the upper surface of the second electroconductive layer 15, thereby forming the electron-emitting film 3. Note that the growth condition is not limited to this condition.

EXAMPLE 4

In this example, as shown in FIG. 2B, the anode electrode 8 was arranged above the electron-emitting device manufactured in Example 1. Then, a voltage was applied to the anode electrode 8 and a voltage was applied between the cathode electrode 2 and the gate electrode 7 to measure electron-emitting characteristics of the electron-emitting device.

With respect to applied voltages, Va=10 kV and Vb=20 kV. The distance H between the electron-emitting film 3 and the anode electrode 8 was set to 2 mm. Here, an electrode to which a phosphor was applied was used as the anode electrode 8 and an electron beam size was observed. The electron beam size described here indicates a size corresponding to a region in which the luminance of the phosphor that emits light was equal to or larger than 10% of the peak. The electron beam diameter became 80 μm/80 μm (x/y).

In addition, electron-emitting characteristics of the electron-emitting devices manufactured in Examples 2 and 3 were measured in this example. Therefore, the beam diameter was reduced and the electron-emitting device was driven at a low voltage.

EXAMPLE 5

An image display device was produced using the electron-emitting device manufactured in Example 3. 100×100 electron-emitting devices described in Example 3 were arranged in matrix. With respect to wiring, as shown in FIG. 5, each of the wirings (Dx1 to Dxm) of the X-directional wirings was connected with the cathode electrode 2, and each of the wirings (Dy1 to Dym) of the Y-directional wirings was connected with the gate electrode 7. The respective electron-emitting devices were arranged at pitches of 300 μm in a transverse direction and 300 μm in a longitudinal direction. The phosphor was arranged above the respective electron-emitting devices. As a result, an image display device was produced in which matrix drive was possible, a resolution was high, and a variation in brightness was small.

According to the manufacturing method of the present invention, the opening width of the focusing electrode is controlled and the process margin is increased, so that a variation in brightness on a display screen is reduced. In addition, the spread of the electron beam is made uniform to prevent color mixing. Thus, a display device which has a small halo and is clear can be produced with a high yield.

What is claimed is:

1. A method of manufacturing an electron-emitting device, comprising:

(A) arranging on a substrate a member comprising a first electroconductive layer blanketing the substrate, a layer containing at least one of materials composing an electron-emitting element blanketing the first electroconductive layer, a protective layer blanketing the layer containing at least one of materials forming an electron-emitting element, a second electroconductive layer blanketing the protective layer, an insulating layer blanketing the second electroconductive layer, and a third electroconductive layer blanketing the insulating layer;

(B) forming an opening, which extends from a surface of the third electroconductive layer to the protective layer, by dry etching; and (C) wet-etching the protective layer through the opening to expose a portion of the layer containing at least one of the materials forming the electron-emitting element.

2. A method of manufacturing an electron-emitting device according to claim 1, wherein the protective layer is made of a material having a lower etching rate than the second electroconductive layer.

3. A method of manufacturing an electron-emitting device according to claim 1, wherein the protective layer is made of a metal.

4. A method of manufacturing an electron-emitting device according to claim 1, wherein the protective layer is made of one of a silicon nitride and a silicon oxide.

5. A method of manufacturing an electron-emitting device according to claim 1, wherein the first electroconductive layer composes a cathode electrode, the second electroconductive layer composes a focusing electrode, and the third electroconductive layer composes a gate electrode.

6. A method of manufacturing an electron-emitting device according to claim 1, wherein the electron-emitting element contains mainly carbon.

7. A method of manufacturing an electron-emitting device according to claim 1, wherein the electron-emitting element is one of diamond, diamond-like carbon, and a carbon fiber.

8. A method of manufacturing an electron source including a plurality of electron-emitting devices, the method comprising:

manufacturing the electron-emitting devices by the manufacturing method according to claim 1.

9. A method of manufacturing an image display device including an electron source and a light emitting member that emits light by electron irradiation, the method comprising:

manufacturing the electron source by the manufacturing method according to claim 8.

* * * * *

UNITED STATES PATENT AND TRADEMARK OFFICE

CERTIFICATE OF CORRECTION

PATENT NO. : 7,074,102 B2
APPLICATION NO. : 10/758193
DATED : July 11, 2006
INVENTOR(S) : Yoji Teramoto It is certified that error appears in the above-identified patent and that said Letters Patent is hereby corrected as shown below:

ON THE TITLE PAGE [57] ABSTRACT:

Line 9, “materials,” should read --the materials,--.

COLUMN 1:

Line 58, “JP 3010305” should read --JP 3-10305--.

COLUMN 3:

Line 57, “electrode(first” should read --electrode (first--;
Line 59, “trode(second” should read --trode (second--; and
Line 60, “electrode(third” should read --electrode (third--.

COLUMN 6:

Line 57, “element(ex.” should read --element (ex.--.

COLUMN 7:

Line 29, “an” (second occurrence) should be deleted;
Line 30, “a” should be deleted;
Line 32, “is” should read --are--; and
Line 64, “is” should read --are--.

COLUMN 8:

Line 1, “is” should read --are--.

COLUMN 9:

Line 28, “(nor” should read --(not--; and
Line 29, “solution 104:” should read --solution 104;--.

COLUMN 10:

Line 18, “solution 104:” should read --solution 104;--; and
Line 34, “(catalytic,” should read --(catalytic--.

UNITED STATES PATENT AND TRADEMARK OFFICE

CERTIFICATE OF CORRECTION

PATENT NO. : 7,074,102 B2
APPLICATION NO. : 10/758193
DATED : July 11, 2006
INVENTOR(S) : Yoji Teramoto It is certified that error appears in the above-identified patent and that said Letters Patent is hereby corrected as shown below:

COLUMN 11:

Line 5, "solution 104:" should read --solution 104;--.

Signed and Sealed this

Twentieth Day of February, 2007

JON W. DUDAS
*Director of the United States Patent and Trademark Office*